US005699634A

United States Patent [19]

Erdahl

[11] Patent Number: 5,699,634

[45] Date of Patent: Dec. 23, 1997

[54] CHRISTMAS TREE WATERER

[76] Inventor: Lowell O. Erdahl, 1773 Eldridge Ave. W., Roseville, Minn. 55113-5688

[21] Appl. No.: 613,471

[22] Filed: Mar. 11, 1996

[51] Int. Cl.[6] ..... A47G 7/02; A47G 33/12

[52] U.S. Cl. ..... 47/40.5; 47/79

[58] Field of Search ..... 47/79 V, 40.5, 47/79 R

[56] References Cited

U.S. PATENT DOCUMENTS

| | | | |
|---|---|---|---|
| 727,597 | 5/1903 | Day . | |
| 1,253,146 | 1/1918 | Caskey, Jr. . | |
| 1,635,498 | 7/1927 | Pershing . | |
| 1,842,687 | 1/1932 | Reynolds . | |
| 2,938,304 | 5/1960 | Thomas et al. . | |
| 3,469,342 | 9/1969 | Morris . | |
| 4,148,155 | 4/1979 | Allen . | |
| 4,281,625 | 8/1981 | Kasai | 47/79 V |
| 4,578,897 | 4/1986 | Pazar et al. . | |
| 4,850,137 | 7/1989 | Foster | 47/40.5 |
| 5,009,028 | 4/1991 | Lorenzana et al. | 47/40.5 |
| 5,259,142 | 11/1993 | Sax . | |
| 5,473,837 | 12/1995 | Skoczylas et al. | 47/40.5 |

FOREIGN PATENT DOCUMENTS

| | | | |
|---|---|---|---|
| 1499981 | 3/1966 | France | 47/79 V |
| 1473290 | 2/1967 | France | 47/79 V |
| 2322533 | 4/1977 | France | 47/79 V |
| 2446592 | 9/1980 | France | 47/79 V |
| 2469870 | 6/1981 | France | 47/79 V |
| 2650099 | 10/1976 | Germany | 47/79 V |
| 90084 | 8/1957 | Norway . | |

*Primary Examiner*—Terry Lee Melius
*Assistant Examiner*—Joanne C. Downs
*Attorney, Agent, or Firm*—James W. Miller

[57] ABSTRACT

A waterer for supplying water to the basin of a device in which a plant is contained, such as to a tree stand for supporting a Christmas tree. The waterer includes a bottle having a neck with the bottle capable of being inverted such that the neck is received within the basin. The neck includes a cap that may be easily opened and closed. The cap is kept closed while the bottle is being inverted and installed, and is then easily opened to allow the water in the bottle to communicate with the basin. A hook and an adjustable strap are carried on the other end of the bottle for suspending or hanging the bottle from one of the branches of the tree or from another similar object.

16 Claims, 2 Drawing Sheets

CHRISTMAS TREE WATERER

TECHNICAL FIELD

This invention relates to a waterer for automatically adding water to a plant containing basin, such as the basin of a tree stand in which a Christmas tree is supported, to replace water drawn from the basin by the plant.

BACKGROUND OF THE INVENTION

The tradition is widely followed of cutting small, evergreen trees, of decorating the trees, and of displaying such trees indoors to celebrate the Christmas season. Various tree stands are known for supporting such Christmas trees. Such tree stands typically comprise an upwardly facing, open topped basin for containing water that is supplied to the cut tree to slow the drying of the tree. The tree is supported in the stand with the trunk being placed and held in an upright orientation in the middle of the basin.

The basin of the tree stand is large enough to hold a relatively large supply of water that surrounds the lower end of the tree trunk. This water is drawn into the tree through the cut lower end of the trunk to replace the natural loss of water experienced by the tree as the tree dries. Thus, the water provided by the tree stand retards the drying of the tree and keeps it sufficiently hydrated over the period in which the tree is displayed to prevent the tree from becoming a fire hazard. However, the water needs of the tree are large, such that the water within the basin of the tree stand will often be completely depleted.

In known tree stands of this type, the user must manually monitor the water level within the basin and refill it when it gets low. This must often be done every day or every other day depending on how quickly the tree draws up the water within the basin. Unfortunately, many people are not diligent about checking and refilling the basin with the result that the basin often goes dry. Without a water supply to draw upon, the tree itself will then quickly dry out, perhaps without the user even realizing it. A dry tree is a much greater fire hazard or, at the least, begins dropping its needles. Thus, drying the Christmas tree out is something which is desirably avoided.

Various devices have been proposed for adding water automatically to the basin of a Christmas tree stand. In one such device, a waterer that is separate from the tree sits on the floor some distance away from the tree stand. The neck of an inverted, 2 liter soda bottle can be inserted into the waterer with the soda bottle being filled with water. An elongated hose several feet in length connects the bottom of the waterer to the basin of the Christmas tree stand. U.S. Pat. No. 3,469,342 to Morris shows a Christmas tree waterer of this general type.

While devices such as these will automatically add water to the tree stand, thus somewhat alleviating the need to check the basin often and refill it when needed, they have various disadvantages. For example, using a floor supported waterer spaced from the Christmas tree with a long hose extending to the tree stand is unsightly and detracts from the appearance of the Christmas tree itself. This is particularly true since the waterer is preferably located at some spot where the user has access to it for the purpose of refilling the waterer, i.e. at the front or sides of the tree and not in the back of the tree. Accordingly, many people will not use such a waterer as it is not aesthetically pleasing.

In addition, any waterer that uses a long hose to conduct water to the tree stand has inherent disadvantages. The hose adds expense due to the cost of providing the hose. In addition, many existing tree stands have no nipple that the hose can be attached to. Thus, the hose is simply laid into the top of the basin of the tree stand. If the hose is somehow pulled out of the basin, as by someone who accidentally catches a foot on the hose and pulls it out of the basin, the waterer will immediately discharge its contents through the hose onto the floor surrounding the Christmas tree. This can damage the floor and any gifts that might have been placed under the tree. Similarly, the other end of the hose could be accidentally pulled out of the waterer, thus causing the contents of the waterer to discharge onto the floor around the waterer. Accordingly, the possibility of dislodging the hose with spillage of the contents of the waterer onto the floor is a major disadvantage of this type of waterer.

It would be possible to provide a tree stand with a hose receiving nipple onto which the hose could be clamped in an attempt to solve the problem of hose dislodgement. In fact, this is shown in the Morris patent described above. However, this requires the simultaneous purchase of a specially constructed tree stand, i.e. a stand having such a nipple, which substantially raises the cost of purchasing such a waterer. Moreover, given enough force, it is still possible to pull the hose off of such a nipple, thus still giving rise to the water leakage problem noted above. In addition, most tree stands in use today have no such nipple leading into the basin. Thus, when using this waterer with most tree stands that already exist, the hose is still simply laid into the top of the water containing basin of the tree stand where it is easy to dislodge.

SUMMARY OF THIS INVENTION

One aspect of this invention is to provide an automatic waterer for a Christmas tree stand or similar plant containing basin that is inexpensive, durable and easy to use. The tree stand of this invention will not leak or spill water during use, thus avoiding the difficulties and dangers of waterers having elongated hoses.

This and other aspects of this invention are provided by a waterer which comprises a bottle for holding a supply of water, the bottle having a neck at one end. A cap is provided on the neck of the bottle having open and closed positions for blocking and permitting water flow through the cap and hence through the neck and from the bottle. A means is provided for suspending the bottle from a branch of the plant in an inverted position with the neck of the bottle extending down into and being received inside the basin. The cap can be placed into its open position after installation of the bottle in its inverted position to allow the water inside the bottle to communicate with the basin.

Another aspect of this invention comprises the use of a particular type of suspension means with the bottle. Preferably, the suspension means includes a hook or hangar received on a strap or other member having an adjustable length. Thus, the length of the suspension means can be adjusted to allow the bottle to be suspended from branches on the plant located at different heights from the water containing basin.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
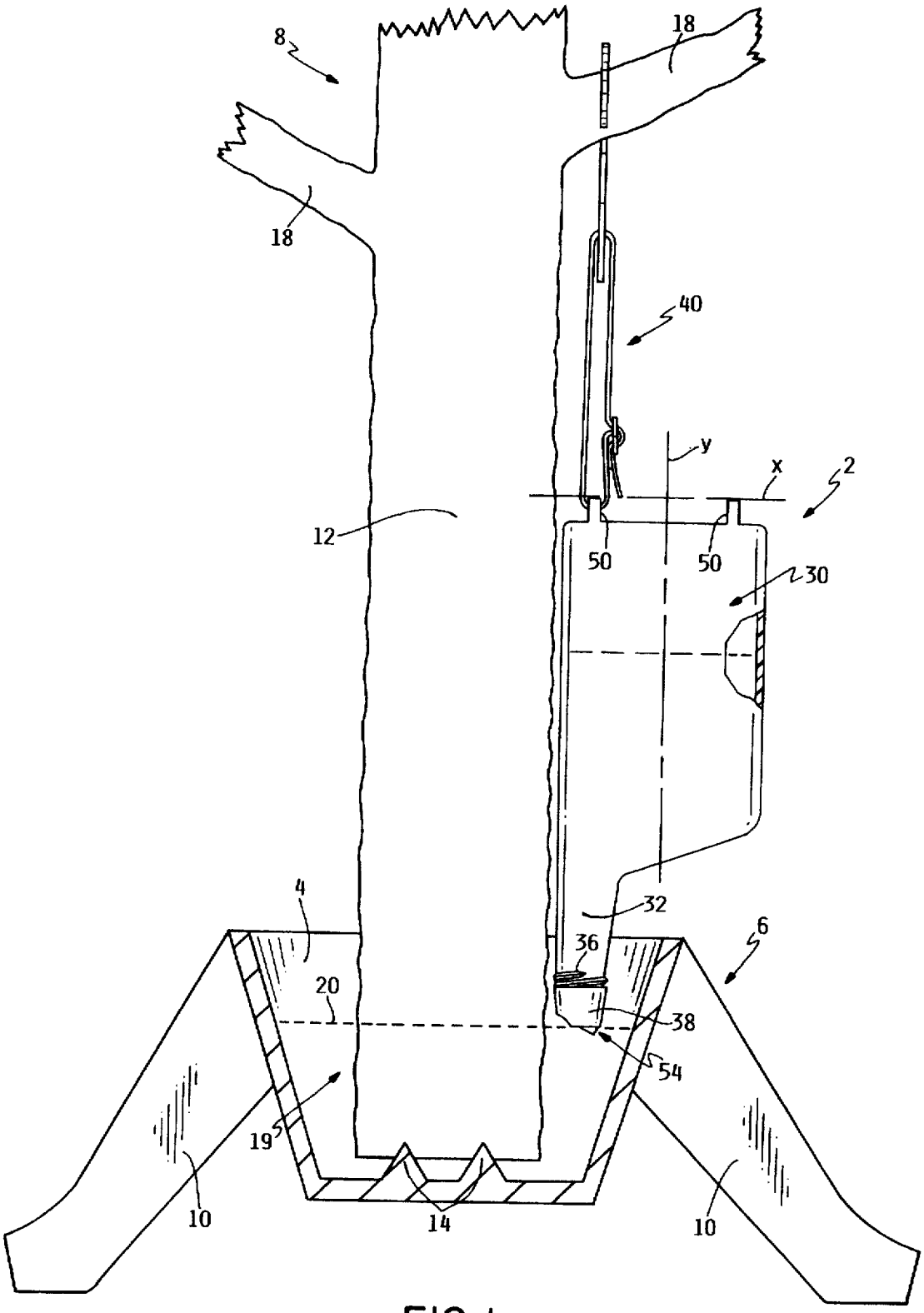
FIG. 1 is a side elevational view of the lower end of a Christmas tree or similar plant supported within a first type of tree stand, particularly illustrating the waterer of this invention shown inverted and in place for providing water to the basin of the tree stand, a portion of the waterer being broken away and shown in cross-section.

This invention comprises a waterer, indicated generally as 2, for automatically adding water to a plant containing basin 4. As shown in FIG. 1, a primary use of waterer 2, but not an exclusive use, is to add water to basin 4 of a tree stand 6 used to support a Christmas tree 8. Tree stand 6 is of any conventional type but includes an open topped, upwardly facing basin 4 supported by a plurality of floor engaging legs 10. The lower end of the trunk 12 of tree 8 extends down into tree stand 6 and is engaged with a plurality of upwardly extending spikes 14 provided on the bottom of basin 4. Tree stands 6 of this type support tree 8 in a vertically upright position, as shown in FIGS. 1 and 3.

Figure 3:
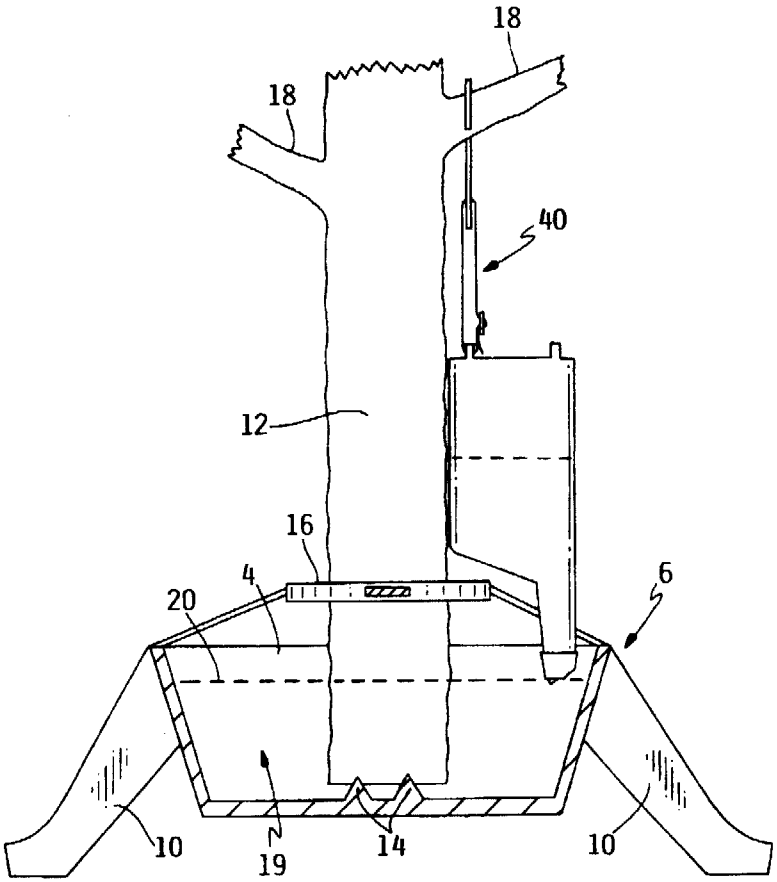
FIG. 3 is a view similar to FIG. 1, but showing the waterer in a different orientation for use with a second type of tree stand.

Two types of tree stands 6 are shown in FIGS. 1 and 3. In the second type of tree stand 6 shown in FIG. 3, stand 6 includes a large, upper, circular support ring 16 through which tree trunk 12 extends as it goes down into tree stand 6. Waterer 2 of this invention is designed to work with such a tree stand 6 even when a large support ring 16 is present. The first type of tree stand 6 shown in FIG. 1 is smaller and may lack support ring 16 or have a small support ring 16. Nonetheless, waterer 2 of this invention is also designed to work with such a tree stand 6.

Regardless of the type of tree stand 6 that might be used to support tree 8, tree 8 will have a plurality of branches 18 that are located at different heights along trunk 12. Two such branches 18 are shown in FIG. 1. As is obvious, each tree 8 is different so that it is impossible to predict where branches 18 will be located along trunk 12. All that is certain is that a given tree 8 have a plurality of branches 18 and such branches will be located along tree trunk 12 at different heights relative to tree stand 6.

The purpose of tree stand 6 is to contain a supply 19 of water in basin 4 surrounding the lower end of tree trunk 12. The surface or level of this water supply is indicated at 20 in FIGS. 1 and 3. The water level 20 can be at different heights within basin 4, though typically it is set somewhere close to the top of basin 4. Water supply 19 provides water which tree 8 can draw upon depending on the needs of tree 8. Thus, tree 8 can draw water from water supply 19, thereby lowering water level 20, to replace moisture that tree 8 loses through evaporation. The purpose of waterer 2 is to automatically add water back into basin 4 as tree 8 draws water out, thereby keeping water level 20 more or less constant as long as waterer 2 has some water within it.

Waterer 2 includes a container or bottle 30 having an integrally formed neck 32 at one end. Neck 32 is relatively narrow being less than the cross-sectional width of bottle 30. Neck 32 is also shorter in length than the rest of bottle 30. Thus, when bottle 30 is inverted as shown in FIGS. 1 and 3, the short neck 32 allows the bulk of bottle 30 to be kept as low as possible within tree 8, where it is less likely to interfere with branches 18.

The external diameter of neck 32 is threaded having a plurality of screw threads 36. This allows a cap 38 to be removably attached to neck 32 for opening and closing water flow from bottle 30. Cap 38 can be completely removed from neck 32 for conveniently filling bottle 30 with water. This will be described in more detail hereafter.

Neck 32 is preferably offset relative to a vertical axis y extending through the center of bottle 30 so as to be located along one side of bottle 30. This non-symmetrical orientation of neck 32 is useful in placing waterer 2 within the two types of different tree stands 6 shown in FIGS. 1 and 3. As shown in FIG. 1, when the tree stand 6 permits, bottle 30 is desirably installed with neck 32 placed along and in close proximity to trunk 12 of tree 8. However, in a tree stand 6 in which a large support ring 16 intrudes and prevents this placement, bottle 30 can simply be rotated 180° about its vertical axis y to allow neck 32 to clear support ring 16. This reversed orientation of bottle 30 is shown in FIG. 3.

The end of bottle 30 opposite to neck 32 is provided with a means for suspending or hanging bottle 30 from one of the branches 18 of tree 8 or any similar objects located above basin 4. For example, when basin 4 contains a plant less massive than tree 8, a chair could be positioned with its back located next to basin 4. In such an event, bottle 30 could then be suspended from some point on the chair.

Figure 2:
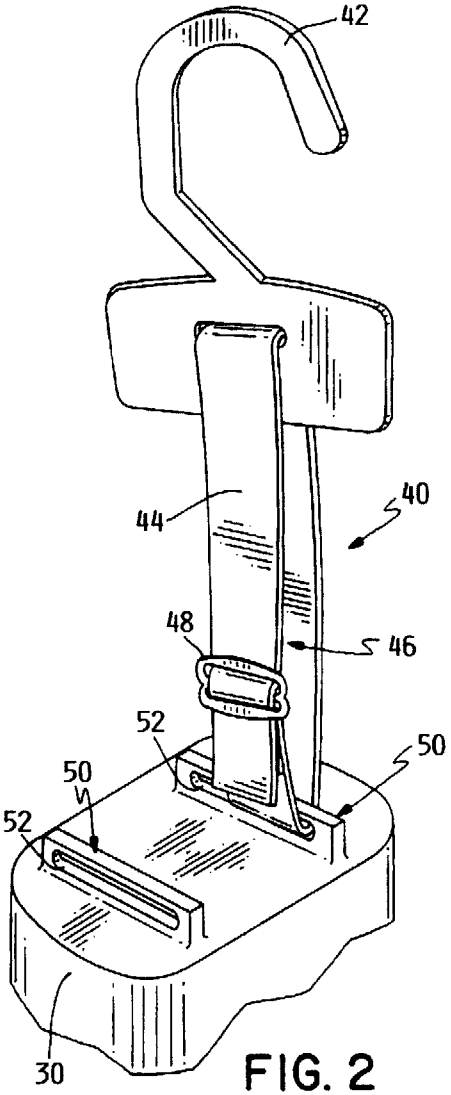
FIG. 2 is a perspective view of a portion of the waterer shown in FIG. 1, particularly illustrating the means for suspending or hanging the waterer in its inverted orientation.

In any event, the bottle suspension means is indicated generally as 40 in FIGS. 1 and 3. Referring now to FIG. 2, suspension means 40 comprises a hook 42 connected to bottle 30 by a length extendible member 44, preferably a flexible strap. The length of strap 44 can be adjusted in a known fashion by forming strap 44 as a loop 46 and passing the two ends of strap 44 through an adjustment clasp or bracket 48. The length of loop 46 can be easily adjusted in a known manner by how much or how little the ends of strap 44 are drawn through bracket 48. Any suitable adjustment clasp or bracket 48 may be used.

The end of bottle 30 opposite to neck 32 is provided with two spaced strap hangars 50 each having a slot 52 through which strap 44 can be passed. Thus, bottle 30 has at least two attachment points formed by the two strap hangars 50 for suspension means 40. Preferably, the suspension means 40 passes close to tree trunk 12 when suspending bottle 30, as shown in FIG. 1, so that the weight of the filled bottle 30 does not tend to tip the tree 8, i.e. the moment arm defined by the distance between trunk 12 and hook 42 is minimized. Having two spaced strap hangars 50 positioned as shown allows this "close to the trunk" orientation of suspension means 40 to be accomplished whether the bottle 30 is in its FIG. 1 position or the reversed position of FIG. 3 since at least one strap hangar 50 will be positioned close to trunk 12 in either position of bottle 30.

Both of the strap hangars 50 protrude slightly from the end of bottle 30, but they both terminate in a common plane indicated as x in FIG. 1. Thus, bottle 30 can be set upright and supported on a horizontal surface, such as the bottom of a sink or a table top, with bottle 30 being self-supporting on the two strap hangars 50. Bottle 30 can be conveniently filled in this upright position after first removing cap 38 by screwing cap 38 off neck 32. Neck 32 can then be placed beneath a faucet, such as that found in a wash basin or deep sink or the like to allow bottle 30 to be placed beneath the faucet, and the faucet turned on to substantially fill bottle 30 with water. Preferably, bottle 30 has a substantial storage capacity, e.g. at least one liter and preferably two liters of water. After bottle 30 is filled in this manner, cap 38 can be screwed back on.

Once bottle 30 is filled, suspension means 40 is used to suspend bottle 30 in an inverted condition with neck 32 of bottle 30 extending downwardly into the top of tree stand 6. In this position, water contained in the bottle 30 can be used to keep the water level 20 within basin 4 at a desired level as determined by the level of a water outlet 54 on neck 32. When the tree draws water from basin 4, and the water level 20 drops below the level of water outlet 54 in neck 32, then additional water will flow down from bottle 30 until the water level 20 rises and covers up water outlet 54 in neck 32. This continues until the water supply inside bottle 30 is exhausted. Then, bottle 30 has to be refilled to continue its water replenishment function. However, since bottle 30 has a substantial storage capacity, this will not have to be done nearly as often as basin 4 would have to be refilled if bottle 30 were not present.

Figure 4:
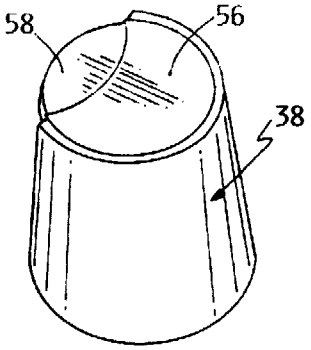
FIG. 4 is an enlarged perspective view of a cap that forms part of the waterer shown in FIG. 1, the cap being shown in its closed orientation preventing water flow through the cap.
Figure 5:
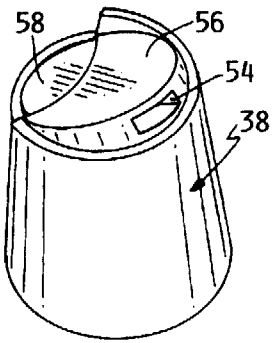
FIG. 5 is an enlarged perspective view similar to FIG. 4, but showing the cap in its open orientation allowing water flow through the cap.

Any suitable water outlet 54 could be provided in neck 32. However, one convenient way to provide such an outlet 54 is to place it in cap 38 and to use a cap 38 that can be easily opened and closed to open and close water outlet 54. One version of cap 38 that accomplishes this is shown in FIGS. 4 and 5.

Cap 38 is a well known cap of the type often used on shampoo bottles or the like. It includes a pivotal flip top 56 that can be flipped between a closed position, shown in FIG. 4, to an open position, shown in FIG. 5, by pressing down on one side of cap 38 at an indentation 58. In the closed position, water outlet 54 provided in cap 38 is closed by the body of cap 38 to prevent any water flow. However, when the user presses down on indentation 58 and flips top 56 open, water outlet 54 is exposed and water can now flow down from bottle 30 through cap 38. Water outlet 54 is sufficiently large, or multiple outlets 54 are used with a combined size, such that the surface tension of the water in water supply 19 will not prevent water from flowing out of bottle 30 through water outlet 54.

Use of a "flip open" cap of this type is preferred since it allows one to retain the water within bottle 30 while bottle 30 is being inverted and installed in tree stand 6 and suspension means 40 is being engaged. However, once placement of bottle 30 is completed and neck 32 of bottle 30 is received within basin 4 of tree stand 6, the user need only reach cap 38 and flip it open to uncover water outlet 54 provided in cap 38 and to allow the water inside bottle 30 to flow into basin 4 as need be. Cap 38 can be easily opened by the user even if neck 32 of bottle 30 is submerged within the existing water supply 19 within basin 4 beneath the water level 20 thereof. The user can still easily reach and flip open cap 38 simply using feel.

It is preferred that cap 38 be used to provide a selectively openable water outlet 54 on neck 32 since it can be closed during installation of bottle 30 to prevent leakage or spillage from bottle 30. Once bottle 30 is installed, cap 38 can be flipped open to place waterer 2 into operation. However, the overall configuration of bottle 30 and use of suspension means 40 does not depend upon use of a cap 38 of this type. Thus, any convenient water outlets 54 could also be used in neck 32 even if such water outlets were continuously open, such as using bottle 30 without any cap 38 on neck 32, without affecting the advantages provided by suspension means 40.

Other types of easily openable caps could be used in place of that shown in FIGS. 4 and 5 as long as such caps are easy to open using a quick action of one's fingers. For example, in other known "flip open" caps, the entire top is pivotal between a sealing engagement with a central outlet 54 covered beneath the top to a non-sealing, spaced orientation relative to that opening 54 in which the top has been swung off opening 54. In this arrangement, the top often includes a tab that sticks out from one side of the top. The user can engage the tab with a thumb or finger to flip the top open. Such a cap having this type of pivotal top could be used in place of cap 38 shown in FIGS. 4 and 5.

Similarly, water bottles are known used by athletes or persons who are exercising which have threaded caps that include a stem type water outlet that can be pushed in to close the outlet or pulled out to open the outlet. Again, the user easily manipulate and open and close this type of "pull open" cap. Accordingly, such a "pull open" cap can also be used in place of cap 38 shown in FIGS. 4 and 5.

The use of a suspension means 40 having an adjustable length is a desirable feature. It allows bottle 30 to be located with its neck 32 inside the top of tree stand 6, i.e. inside the top of basin 4, regardless of the height of the nearest or most convenient branch 18 on tree 8. Strap 44 can easily have its length adjusted the required amount until hook 42 is received around such branch 18. Thus, bottle 30 can be suspended in its inverted position from different branches 18 located at different heights depending upon which branch 18 or other supporting object is best shaped or most conveniently located.

In addition, the vertical orientation of suspension means 40 can shift or adjust relative to bottle 30 due to the flexible nature of strap 44. While suspension means 40 might often be located so that it hangs straight down from a branch 18 as shown in FIGS. 1 and 3, this may not always be possible. For example, the branch 18 at the location where hook 42 would normally engage it close to trunk 12 may be too thick at that point to allow hook 42 to easily hooked onto branch 18. Thus, it might be necessary to sometimes locate hook 42 further out on branch 18, i.e. at the junction between branch 18 and a secondary branch, such that suspension means 40 assumes a tilted or inclined orientation relative to bottle 30. The flexible connection between suspension means 40 and bottle 30 easily accommodates the change in orientation that might be required for suspension means 40.

Preferably, bottle 30 is conveniently molded as a single piece from a lightweight plastic material. The material should be strong enough so that it will not deform as water is drawn out of bottle 30 and drains down into tree stand 6. Similarly, cap 38 is molded out of plastic and is formed of two pieces with one piece simply moving relative to the other to open and close water outlet 54. No flow controlling valve is needed other than for the opening and closing action of cap 38. Accordingly, the entire waterer 2, i.e. both bottle 30 and cap 38 can be inexpensively molded using known plastics technology.

Preferably, the plastic material from which bottle 30 is molded is transparent so that the level of the water supply within bottle 30 can be seen by the user. Thus, the user can visually track this water level and refill bottle 30 before it runs out.

Waterer 2 is extremely easy to use. Bottle 30 can be filled by the user simply by placing the open neck 32 of bottle 30 beneath a faucet. After bottle 30 is filled, cap 38 is easily be screwed onto neck 32 with cap 38 having been placed into its closed position. Bottle 30 is then inverted with the cap closed until neck 32 is received inside basin 4. Hook 42 is then hooked around a convenient branch 18 so that neck 32 is located at a desired level within basin 6, the user extending the length of strap 44 if need be to reach the right branch 18 or bending or twisting strap 44 if need be to cause hook 42 to reach a particular spot on branch 18. Once bottle 30 is so installed, the user can then simply reach cap 38 and flip or pull it open to allow waterer 2 to be placed into operation.

Various modifications of this invention will be apparent to those skilled in the art. For example, means other than a strap 44 could be used to connect hook 40 to bottle 30 as long as such a means is extendible in length. Moreover, instead of outwardly projecting, external strap hangars 50, bottle 30 could have internal, pocket type strap hangars 50 molded into the end opposite neck 32. One strap hangar 50 could be used instead of two. In addition, as noted earlier, waterer 2 is not limited for used with Christmas trees or with tree stands 6, but can be used more generally in plant containing basins regardless of the nature of basin 4 or the plants within basin 4. Accordingly, this invention is to be limited only by the appended claims.

I claim:

1. A waterer for automatically adding water to a basin to replace water drawn from the basin by a water consuming object, which comprises:

(a) a bottle for holding a supply of water, the bottle having a neck at one end;

(b) a water outlet provided on the neck of the bottle; and (c) means located on an end of the bottle opposite to the neck for suspending the bottle from above the basin in an inverted position with the neck of the bottle extending down into and being received inside the basin such that the water outlet on the neck of the bottle is beneath a top edge of the basin, wherein the suspension means has an extendible length to allow the suspension means to engage supporting objects located at different heights from the basin.

2. The waterer of claim 1, wherein the suspension means is flexible relative to the bottle so that its vertical orientation can be changed relative to the bottle when required.

3. The waterer of claim 2, wherein the suspension means includes a flexible strap.

4. The waterer of claim 1, wherein the one end of the bottle on which the suspension means is located has a plurality of attachment points for the suspension means.

5. The waterer of claim 1, further including a cap located on the neck for opening and closing the water outlet.

6. The waterer of claim 5, wherein the bottle is integrally molded from plastic, the cap further being molded from plastic.

7. The waterer of claim 5, wherein the water outlet is provided in the cap, wherein the cap is made of multiple pieces at least one of which is movable to cover and uncover the water outlet.

8. The waterer of claim 7, wherein the cap is removably attached to the neck so that the cap can be completely removed from the neck for filling the bottle with water.

9. The waterer of claim 1, wherein the bottle is made from a transparent material so that the water level within the bottle can be viewed by the user.

10. A waterer for automatically adding water to a basin to replace water drawn from the basin by a water consuming object, which comprises:

(a) a bottle for holding a supply of water, the bottle having a neck at one end;

(b) a water outlet provided on the neck of the bottle; and (c) means located on the bottle for suspending the bottle in an inverted position with the neck of the bottle extending down into and being received inside the basin such that the water outlet on the neck of the bottle is beneath a top edge of the basin, wherein the suspension means includes a hook or hangar received on a member whose length can be adjusted.

11. The waterer of claim 10, wherein the length adjustable member comprises a flexible strap.

12. A waterer for automatically adding water to a basin to replace water drawn from the basin by a water consuming object, which comprises:

(a) a bottle for holding a supply of water, the bottle having a neck at one end;

(b) a cap on the neck of the bottle having open and closed positions for blocking and permitting water flow through the cap and hence through the neck and from the bottle; and (c) means for suspending the bottle from above the basin in an inverted position with the neck of the bottle extending down into and being received inside the basin, whereby the cap can be placed into its open position after installation of the bottle in its inverted position to allow the water inside the bottle to communicate with the basin, wherein the suspension means has an extendible length to allow the suspension means to engage supporting objects located at different heights from the basin.

13. The waterer of claim 12, wherein the suspension means includes a hook or hangar received on a strap whose length can be adjusted.

14. A waterer for automatically adding water to a basin to replace water drawn from the basin by a water consuming object, which comprises:

(a) a bottle for holding a supply of water, the bottle having a neck at one end;

(b) a cap on the neck of the bottle having open and closed positions for blocking and permitting water flow through the cap and hence through the neck and from bottle, (c) means for suspending the bottle from above the basin in an inverted position with the neck of the bottle extending down into and being received inside the basin to allow the water inside the bottle to communicate with the basin, wherein the suspension means comprises at least one attachment point located at one end of the bottle that is opposite from the neck; and (d) wherein the neck of the bottle is offset to one side of the bottle such that it can be located at different distances from a predetermined spot in the basin by rotating the bottle 180° about a central vertical axis of the bottle.

15. The waterer of claim 14, wherein one end of the bottle has a plurality of attachment points for the suspension means, and wherein the attachment points are so located relative to the one end of the bottle that at least one attachment point is located proximate the predetermined spot in the basin regardless of whether the bottle has been rotated about its central vertical axis or not.

16. The waterer of claim 15, wherein the attachment points comprise external vertical projections on the one end of the bottle each having a slot for receipt of the suspension means, and wherein the vertical projections terminate in a common horizontal plane to allow the bottle to be supported by the vertical projections on a flat surface with the bottle being placed in an upright condition for filling the bottle with water.

* * * * *